US005655266A

United States Patent [19]

Gish

[11] Patent Number: 5,655,266

[45] Date of Patent: Aug. 12, 1997

[54] PAPER CLIP

[76] Inventor: Donald A. Gish, 4832 Sterling Hills Dr., Antioch, Calif. 94509

[21] Appl. No.: 664,820

[22] Filed: Jun. 17, 1996

[51] Int. Cl.[6] ..... B42F 1/02; A44B 21/00

[52] U.S. Cl. ..... 24/67.9; 24/DIG. 10; 24/67.3

[58] Field of Search ..... 24/67.9, 67 CF, 24/67.3, 67 R, 327, 545–548, 551, 555, 553, 556, DIG. 8, DIG. 10, DIG. 28

[56] References Cited

U.S. PATENT DOCUMENTS

| | | | |
|---|---|---|---|
| 1,053,008 | 2/1913 | Carbis | 24/DIG. 10 |
| 1,985,866 | 12/1934 | Lakenau . | |
| 2,642,638 | 6/1953 | Larrabee | 24/67.9 |
| 2,856,666 | 10/1958 | Crothers | 24/546 |
| 2,908,954 | 10/1959 | Chaun | 24/67.9 |
| 2,938,252 | 5/1960 | Scheemaeker | 24/67.9 |
| 3,348,271 | 10/1967 | Miller | 24/67.9 |
| 4,299,013 | 11/1981 | Lincoln | 24/DIG. 10 X |
| 4,480,356 | 11/1984 | Martin | 24/67.3 X |
| 5,008,982 | 4/1991 | Tsukamoto | 24/67.9 |
| 5,022,124 | 6/1991 | Yiin | 24/67.9 |
| 5,319,835 | 6/1994 | Chao | 24/67.9 |

FOREIGN PATENT DOCUMENTS

| | | | |
|---|---|---|---|
| 91/04870 | 4/1991 | WIPO | 24/DIG. 8 |

*Primary Examiner*—James R. Brittain
*Assistant Examiner*—Robert J. Sandy
*Attorney, Agent, or Firm*—Linval B. Castle

[57] ABSTRACT

A paper clip formed of a single resilient wire that can torsionally grasp a thick sheaf of papers without deforming and can be used either along the straight sides of the paper or at a corner.

3 Claims, 1 Drawing Sheet

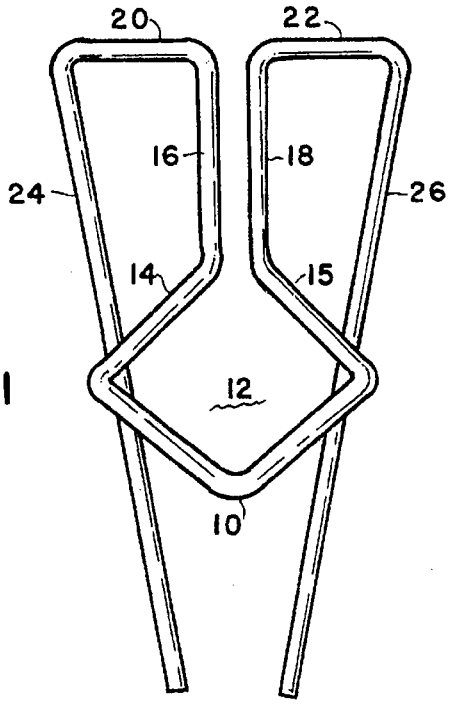
FIG. 1
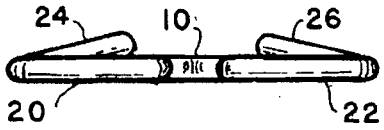
FIG. 2
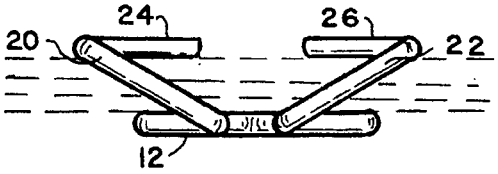
FIG. 3
FIG. 4
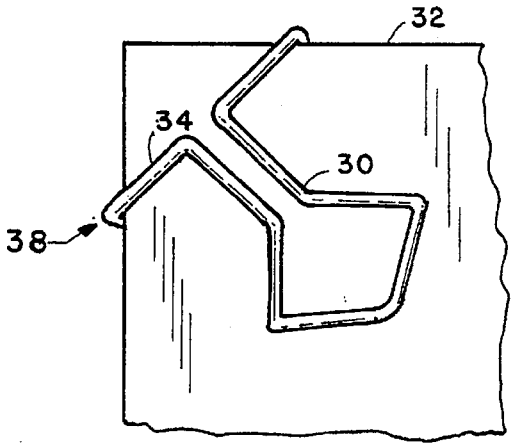

PAPER CLIP

This invention relates generally to paper clips and particularly to a novel paper clip that will firmly hold both a thick and thin sheaf of papers and which can grasp at the corner of a sheaf of papers.

SUMMARY OF THE INVENTION

There are numerous different types of paper clamps and paper clips for temporarily clamping together several sheets or sheaf of papers. The common elongated double loop paper clip such as shown in U.S. Pat. No. 1,985,866 to Lankenau is quite adequate for tamporarily attaching a few sheets of paper, and thicker stacks of paper can be clamped together with the heavier sheet steel binder clip or the wire paper clamps. The steel binder clip is relatively thick and not suitable for clamping only a few papers in a file, and the wire paper clamps and paper clips become deformed if they clamp more sheets than they wer designed for, making them awkward for use in a file.

All of these temporary paper fastening devices perform as intended and with their intended paper load when they are attached along the straight sides or end edges of the paper. They cannot attach properly at a corner of a paper.

This invention is for a paper clip that can tightly clamp a large sheaf of papers together along a straight edge and can also attach a sheaf together when the clip is placed at a corner of the paper.

Briefly described, the paper clip of the invention comprises a single resilient wire with its center bent into an unclosed diamond shaped ring. The wires at the unclosed end of the ring are bent in a first direction, parallel and spaced from each other, and then are bent at a right angle colinearly outwardly in opposite directions parallel with the plane of the ring, and finally are again bent at substantially a right angle into legs that pass the ring and contact its surfaces. Papers are secured in the clip by inserting them between the unclosed diamond shaped ring and the downgoing legs.

BRIEF DESCRIPTION OF THE DRAWINGS

In the drawings which illustrate the preferred embodiment of the invention;

FIG. 1 is a plan view illustrating the paper clip;

FIG. 2 is a top view thereof;

FIG. 3 is a top view showing the clip securing a thick sheaf of papers; and

FIG. 4 illustrates the paper clip positioned at a corner of a sheaf of papers.

DETAILED DESCRIPTION

As illustrated in FIG. 1 the paper clip includes a single resilient wire symmetrically bent from its center which is the bottom corner 10 of the diamond shaped wire ring 12. For a large clip the ring may have branches approximately ½ inch in length. The ring is not closed by connecting the wires 14, 15 together opposite the corner 10 but the wires are bent into straight sections 16,18 that are aligned with the center of the ring and which may be ½ inch long, or approximately the length of maximum width of the ring, and which are parallel and separated from each other.

At the end of the straight sections 16, 18, the two wires are bent in a direction away from each other, colinearly and parallel with the plane of the ring 12, so that each of these cross arms 20,22 form a straight line above the ring. Each of these cross arms are about ½ inch in length and at their ends, the wires are bent back down to form legs 24, 26 that are about 2 inches long. Each of the legs 24, 26 extend down past the ring 12 and each leg contacts two branches of the ring 12.

The lower end of the legs 24, 26 are preferably smoothed or coated with plastic or rubber. The leg ends preferably remain straight and without any protective turns in the wire because, as will be discussed later, the legs rotate with thick loads and any turns in the leg ends will become a "lever" that will extend out from the clip.

The ring 12 is illustrated to be an open diamond or square in shape. The ring serves as one side of the paper clip and may be any convenient shape, such as circular, triangular, etc. The only requirement of the ring is that is serve as one side of the clip and also that it be sufficiently wide so that the legs 24, 26 that form the opposite side of the clip, will contact the surface of the branches and will not readily pass around the side of the ring.

The cross arms 20,22 are preferably straight for overlying thick loads as shown in FIG. 3. They may be alightly arched or curved, but excessive curvature may make the paper clip awkward to use.

FIG. 2 is a top plan view of the paper clip of FIG. 1 showing that the clip has a thickness of two thicknesses of resilient wire and that the very little bending of the empty clip is primarily in the long legs 24,26.

FIG. 3 is a top plan view of the clip securing a thick sheaf of papers, represented by the dashed lines. It is pointed out that the spring action of the clip is principally torsional. In studying FIG. 3, one can appreciate that a thick load on the clip will tend to create a clockwise rotation of the leg 24 and straight section 16 at each end of the cross arm 20 and counterclockwise rotation of the leg 26 and section 18 at each end of the cross arm 22. The legs 24 and 26, being substantially vertical and not bent or connected at the lower end, are free to rotatate without twisting. But the straight sections 16 and 18, being connected together through the ring 12, are restrained from twisting at their lower ends, thereby providing torsion to the clip in an amount depending upon the resiliency and guage of the wire.

There will be very little deformation of the clip when used to secure a thick sheaf and the ring 12 and legs 24,26 will lay flat against the surface of the sheaf. But quite naturally, the springing of resilient paper clip wires will eventually result in their becoming loose and unable to tightly hold a sheaf of papers. When this occurs, the clip may be easily tightened by bringing the legs 24, 26, which are shown to be behind the ring 12 in FIG. 1, around the sides of the ring and to the front where they will tightly contact the front surface of the ring.

One of the main advantages of the paper clip is that it may be used in any position on the edge, or at the corner, of a sheaf of papers. FIG. 4 illustrates a clip 38 at the corner of a paper 32. It will be noted that, in corner applications, the cross arms 34 lie across the face of the paper 32 and not across the top as the cross arms 20, 22 in FIG. 3. Therefore, the capacity of the clip is not as great for corner application as for edge application.

I claim:

1. A paper clip comprising:

a single length of resilient wire having first and second ends;

a ring formed by said wire substantially midway between said first and second ends, said ring being in one plane, having a center and being unclosed with a section of first and second straight, parallel and spaced wires emanating outward from said ring and aligned with said center, said straight section of first and second wires having a length of approximately the maximum width of said ring;

first and second colinear cross arms parallel with the plane of said ring located at the end of said straight section and formed by said first and second wires bent in opposite directions, said cross arms having a length approximately the maximum width of said ring;

first and second elongated legs at the ends of said first and second cross arms, each of said legs extending from a respective one of said cross arms to contact and overlie said ring.

2. The paper clip claimed in claim 1 wherein said ring is rectangular and wherein each of said legs overlie two arms of said. rectangle.

3. The paper clip claimed in claim 1 wherein said elongated legs are readily movable to overlie the opposite side of said ring, the moving of said legs from one side to the opposite side of said ring for tightening the spring tension of said paper clip.

* * * * *